United States Patent [19]

Carmack

[11] 4,158,424

[45] Jun. 19, 1979

[54] RUBBISH BIN LID

[76] Inventor: Martha Carmack, 510 S. Mariposa, Ste. 205A, Los Angeles, Calif. 90020

[21] Appl. No.: 959,490

[22] Filed: Nov. 13, 1978

[51] Int. Cl.[2] ..... B65D 43/14; B65D 51/04

[52] U.S. Cl. ..... 220/343; 220/1 T; 220/88 R; 220/334; 220/429

[58] Field of Search ..... 220/1 T, 334, 337, 88 R, 220/429, 342, 343

[56] References Cited

U.S. PATENT DOCUMENTS

| | | | |
|---|---|---|---|
| 3,015,405 | 1/1962 | Sterling | 220/1 T |
| 3,202,310 | 8/1965 | Tillets | 220/334 X |
| 3,206,061 | 9/1965 | Feldman | 220/88 R |
| 3,628,685 | 12/1971 | Gordon | 220/334 |

*Primary Examiner*—George T. Hall

*Attorney, Agent, or Firm*—Ralph B. Pastoriza

[57] ABSTRACT

The lid is made up of generally rectangular bottom and top walls having their edges sealingly connected to define a hollow interior. A bottom projecting portion is formed of smaller rectangular dimensions to fit within the upper side walls of a rubbish bin in sealing relationship. The top wall of the lid is provided with ribs having parallel central portions and thence diverging towards the corners so that utilizing the lid as a water, grass or snow sled by turning the same upside down, is inhibited. Fire retardant crystals may be incorporated in the hollow interior of the lid to aid in smothering any fire which might occur in a bin covered by the lid. Furthermore, portions of the lid are accordion pleated to permit bending about a transverse axis thereby providing a built in soft hinge preventing shattering of the lid during dumping operations.

8 Claims, 7 Drawing Figures

RUBBISH BIN LID

This invention relates to lids for covering commercail type rubbish bins.

BACKGROUND OF THE INVENTION

Commercial type rubbish bins may vary in capacity from one cubic yard all the way up to eight cubic yards. Generally, these bins have a rectangular top opening for receiving refuse resulting from commercial operations such as at supermarkets, restaurants and similar establishments.

The rubbish bins themselves are provided with fork lift receiving channels on their bottoms or sides so that the entire bin can readily be picked up by a fork lift and dumped into a collection rubbish truck.

Most of the above types of commercial bins include adjacent to their upper rear corners appropriate hardware in the form of hinge rod members having openings for receiving a solid rod serving as a hinge for an appropriate cover or lid.

Ever since the cubic yard container has become the mode of commercial rubbish collection, the lid of the container has been the major problem that plagues the industry. More particularly, the heavy metal of the lid creates accidents ranging from cut hands and fingers to concussions and teeth knocked out to amputation of noses and ears. These hazards create law suits for both hauler and bin maker. In fact, Governments Agencies are presently investigating the rubbish industry and are coming down hard on the safety of the bins.

Aside from the hazards mentioned, most bins have the standard metal lids hanging down in back, useless, because of the weight which makes the lid too cumbersome to lift, and dangerous to have propped up. Even with the lids closed they are not always effective in sealing in odors and keeping out rodents. Moreover, these lids are attractive to youngsters and others for use as water, grass or snow sleds, the same being stolen and then utilized as a sled by turning the lid upside down. Finally, many of the presently available lids have a tendency to crumble or fracture along a transverse mid-axis or section during a dumping operation thus rendering them useless.

As a consequence of some of the foregoing problems, many commercial establishment owners find the lids to be a great expense both in repairs and liability for accidents. Thus, when a lid is broken or stolen, they do not bother to replace the same. As a result, many commercial rubbish bins are simply left in an open condition which not only constitutes a fire hazard but pollutes the surrounding environment with unpleasant odors.

BRIEF DESCRIPTION OF THE PRESENT INVENTION

Bearing the foregoing in mind, the present invention contemplates the provision of a vastly improved rubbish bin lid overcoming or at least substantially reducing the aforementioned problems.

More particularly, the rubbish bin lid of this invention is made of light plastic material with high stress factor and of the type which has a "memory". The lid itself is of generally rectangular shape having a downwardly projecting bottom portion of smaller rectangular dimensions to fit within the upper side walls of the bin when the lid is in open position, thereby sealing the same to prevent escape of odors, flies and the like. The top of the lid in turn includes rib means with portions extending in different directions to thereby inhibit use of the lid as a water, grass or snow sled if turned upside down.

In the preferred embodiment, the lid has a hollow interior which may be filled with fire retardant crystals. The arrangement is such that if a fire occurs in a bin covered by the lid, the fire retardant crystals would then be released to fall onto the fire.

A further feature of the preferred embodiment is the provision of accordion pleated portions effectively creating a hinge permitting flexing of the lid about a mid transverse line or axis thereby allowing the lid to bend without breaking. This feature is important in the dumping operation when the entire rubbish bin and lid is inverted and lowered into the rubbish truck hopper. In this part of the operation, the lid is subject to bending forces and the accordion pleating of this invention permits such bending to take place so that the lid is not broken. Moreover, the lid will return to its natural shape after the rubbish bin is raised from the hopper and lowered to its normal position on the ground. Essentially, the accordion pleating sections act as a shock absorber removing stress from the normal hinge points of the lid to the rubbish bin.

BRIEF DESCRIPTION OF THE DRAWINGS

A better understanding of this invention as well as further features and advantages thereof will be had by referring to the accompanying drawings in which.

DETAILED DESCRIPTION OF THE PREFERRED EMBODIMENT

Figure 1:
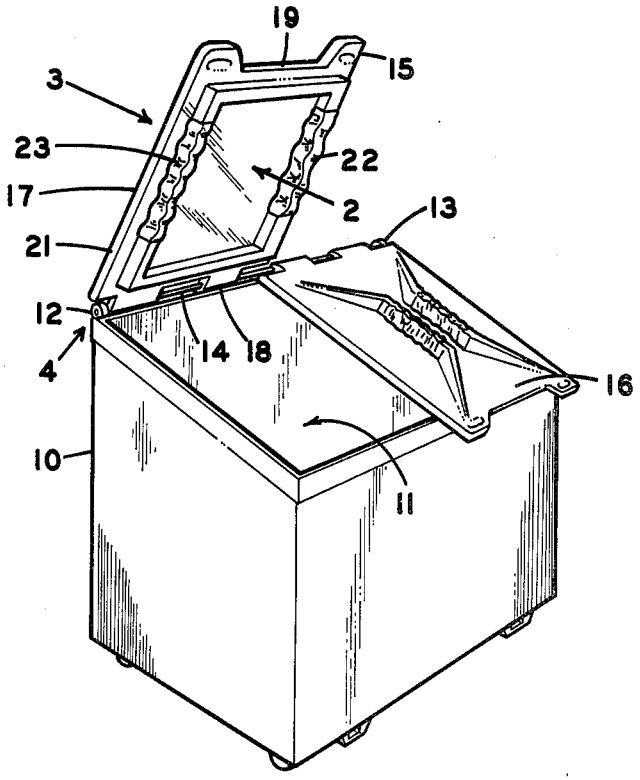
FIG. 1 is a perspective view of a typical commercial rubbish bin with two lids for covering the upper rectangular opening, wherein one of the lids is shown partially raised or open, each of the lids being designed in accord with the present invention.

Referring first to FIG. 1, there is shown a typical commercial rubbish bin 10 having a rectangular top opening 11. The upper edge of the rear wall of the bin is normally provided with members having openings such as indicated at 12 and 13 for receiving a hinge rod 14.

In FIG. 1, there are shown two lids 15 and 16 in side-by-side relationship for covering the rectangular opening 11. Each of these lids is designed in accord with the present invention and each is identical to the other so that a detailed description of one will suffice for both.

Thus, with specific reference to the lid 15 shown in partially open position, the same includes top and bottom generally rectangular walls 17 and 18 having front, rear, left and right edges designated respectively by the numerals 19, 20, 21 and 22, connected together to define a sealed hollow interior.

The lid 15 is preferably made of high stress plastic and manufactured by a molding operation so as to form an integral structure. One type of plastic for molding the lid is available under the trademark MARLEX. The provision of the lids by a molding operation permits certain features to be incorporated resulting in the advantageous lid structure of this invention.

Figure 2:
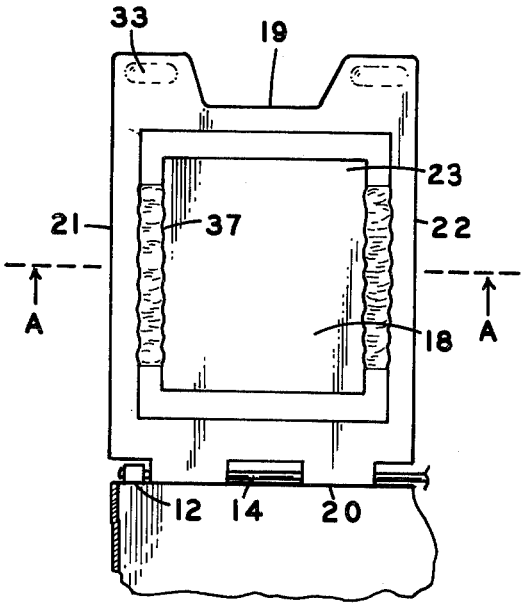
FIG. 2 is a bottom plan view of one of the lids looking in the direction of the arrow 2 of FIG. 1.

More particularly, and with reference to both FIGS. 1 and 2, the bottom wall 18 of the lids includes a downwardly projecting internal channel 23 spaced inwardly of the front rear, left and right edges of the lid as shown. This channel defines a rectangular shape of smaller dimensions than the remaining portion of the lid to fit in sealing relationship within one half of the rectangular top opening 11 of the rubbish bin 10. When the second lid 16 illustrated in FIG. 1 is in side-by-side relationship, the complete rectangular opening 11 of the rubbish bin is closed off.

Figure 3:
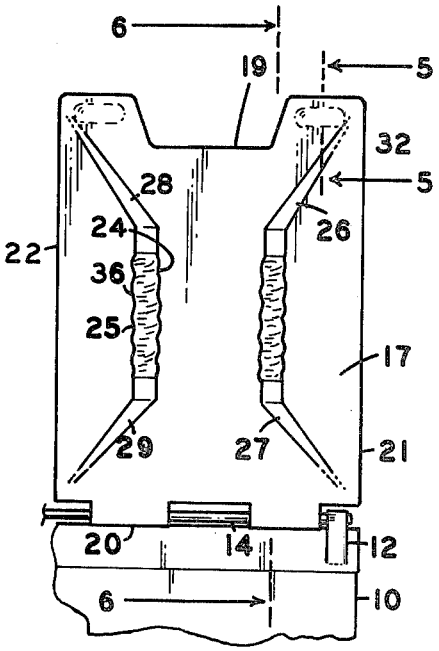
FIG. 3 is a top plan view of the lid of FIG. 2 looking in the direction of the arrow 3 of FIG. 1.

Referring now to the top plan view of FIG. 3, the top wall 17 of the lid includes raised ribs having parallel central portions 24 and 25 which diverge towards the four corners of the lid as indicated at 26, 27, 28 and 29. This structure inhibits the use of the lid as a water, grass or snow sled if turned upside down.

Figure 4:
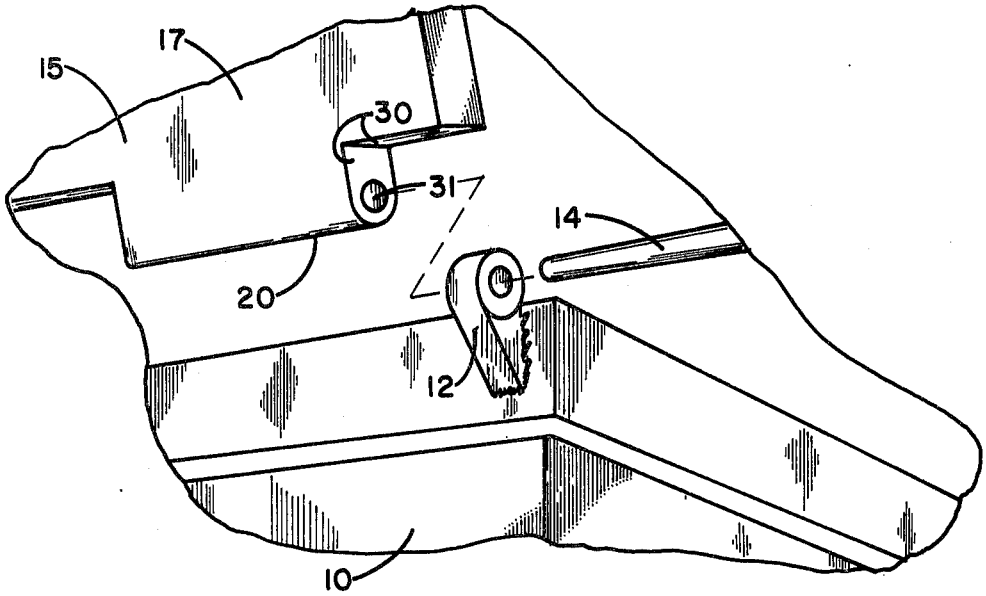
FIG. 4 is an enlarged fragmentary exploded perspective view of a corner portion of the lid and bin looking in the direction of the arrow 4 of FIG. 1.

In both FIGS. 2 and 3, the hinging of the rear edge 20 of the lid by means of the hinge rod 14 and cooperating hinge members on the rear wall of the bin will be evident. Further details of this hinging will be evident by now referring to FIG. 4. Essentially, the rear left and right corners of the lid have cut-outs such as indicated at 30, the remaining portion of the rear edge having further a longitudinal bore 31 passing therealong. The hinge members with openings such as at 12 for the rod 14 fit within the corner cut-outs so that the hole in the member can register with the bore 31 for receiving the hinge rod 14.

Figure 5:
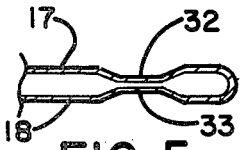
FIG. 5 is a fragmentary cross section taken in the direction of the arrows 5—5 of FIG. 3.

Referring once again to FIGS. 2 and 3, it will be noted that the front edge 19 of the lid includes left and right front corner portions having top and bottom depressions defining handle gripping areas for the lid. A detail of one of these handle gripping areas is illustrated in the cross section of FIG. 5 wherein the top and bottom depressions are shown at 32 and 33.

Figure 6:
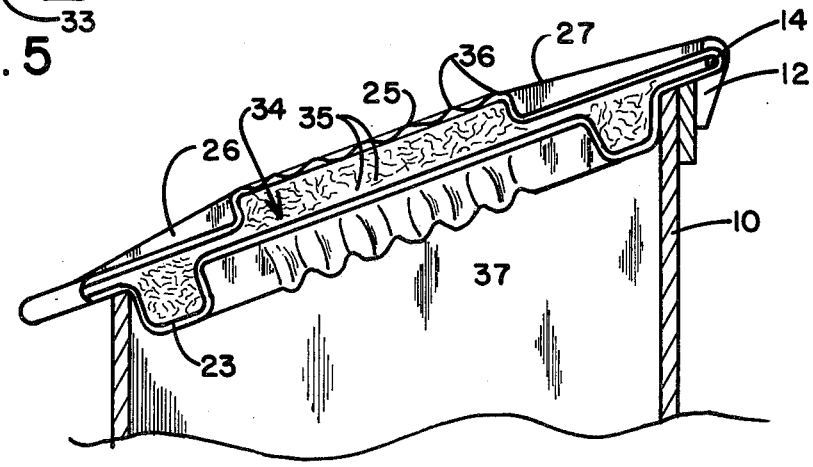
FIG. 6 is a longitudinal cross section taken in the direction of the arrows 6—6 of FIG. 3; and, FIG. 7 is a side elevation of the lid in a flexed position.

Referring now to the cross section of FIG. 6, the hollow interior of the lid is indicated by the arrow 34. In accord with the feature of this invention, this hollow interior may be filled with fire retardant crystals 35. One example of such crystals or granules is manufactured under the trademark VERMECULITE. The arrangement is such that when the lid is covering the bin and a fire breaks out in the bin, the destruction of the lid by the fire will result in the fire retardant crystals 35 dropping onto the fire.

Still referring to FIG. 6, it will be noted that the walls of the central portions of the raised ribs are accordion pleated such as indicated at 36. Also, corresponding central portions of the walls of the downwardly projecting internal channel 23 spaced inwardly of the left and right edges of the lid are similarly accordion pleated as indicated at 37. Referring back to FIGS. 2 and 3, it will be seen that the accordion pleating 36 and 37 will permit flexing or bending of the lid about a transverse mid line or axis indicated at A—A in FIG. 2.

Figure 7:
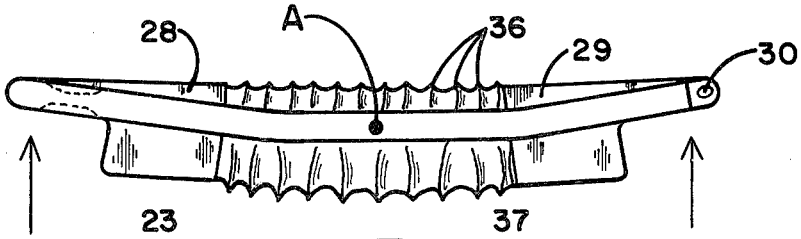

Actual flexing of the lid permitted by this accordion pleating is illustrated in the side elevational view of FIG. 7.

By providing the accordion pleating, the lid is permitted to flex about the transverse mid axis and thus decreases the risk of the lid shattering or breaking as a consequence of bending forces to which the lid is subject during a dumping operation into a rubbish truck hopper, all as briefly described heretofore.

Because of the fit of the reduced rectangular dimensions defined by the downwardly extending internal channel 23, the rectangular opening of the bin of FIG. 1 is essentially sealed against odors escaping when the lids are in their down closed positions. Under heat of the sun, the lid will tend to expand thus increasing the seal in hot weather.

The use of molded plastic permits a light, long-lasting lid to be manufactured once a mold has been provided. In this latter respect, a mold is formed for the largest contemplated lid to be used with the largest capacity commercial bins available. Appropriate inserts may be provided in the mold itself to manufacture reduced dimensioned lids for smaller capacity garbage bins so that essentially, only one major mold need be provided.

From all of the foregoing, it will thus be evident that the present invention has provided a greatly improved rubbish bin lid particularly suitable for commercial type rubbish bins.

I claim:

1. A rubbish bin lid of generally rectangular shape having a downwardly projecting bottom portion of smaller rectangular dimensions to fit within the upper side walls of the bin when the lid is in position, the top of the lid having rib means with portions extending in different directions to thereby inhibit use of the lid as a water, grass or snow sled if turned upside down.

2. A lid according to claim 1, having a hollow interior; and fire retardant crystals filling said interior so that if a fire occurs in a bin covered by the lid, the fire retardant crystals will release to fall onto the fire.

3. A lid according to claim 1, having accordion pleated portions permitting flexing of the lid about a mid-transverse axis.

4. Rubbish bin lids for closing off a generally rectangular top opening of a rubbish bin, the upper edge of the rear wall of said rubbish bin having hinge members secured thereto, with openings for receiving a hinge rod, each of said lids including:

(a) top and bottom generally rectangular walls having front, rear, left and right edges connected together to define a sealed hollow interior, (b) said bottom wall having a downwardly projecting internal channel spaced inwardly of the front, rear, left and right edges of the lid to define a rectangular shape of smaller dimensions than the remaining portions of the lid to fit in sealing relationship within one half of the rectangular top opening of the rubbish bin so that the complete rectangular opening is closed off when two of the lids are in side-by-side relationship, (c) said top wall including raised ribs having parallel central portions which diverge towards the four corners of the lid to thereby inhibit use of such lid as a water, grass or snow sled if turned upside down.

5. A lid according to claim 4, in which fire retardant crystals are provided in said hollow interior.

6. A lid according to claim 4, in which the rear corners of the lid are cut away, the rear edge of the lid having a bore running longitudinally therethrough for receiving said hinge rod, the cut away corners receiving said hinge members on the bin so that the rear edge of the lid is hinged to the bin.

7. A lid according to claim 4, in which the front edge of the lid includes left and right front corner portions having top and bottom depressions defining handle gripping areas for the lid.

8. A lid according to claim 4, in which the walls of said central portions of said raised ribs are accordion pleated and corresponding central portions of the walls of the downwardly projecting internal channel spaced inwardly of the left and right edges of the lid being similarly accordion pleated so that said rectangular lid can flex about a transverse mid-axis.

* * * * *